United States Patent [19]

Scheffler

[11] 4,160,891

[45] Jul. 10, 1979

[54] FURNACE FOR THE INDUCTIVE HEATING OF METALLIC WORKPIECES

[75] Inventor: Friedrich Scheffler, Remscheid, Fed. Rep. of Germany

[73] Assignee: AEG-Elotherm, G.m.b.H., Remscheid, Fed. Rep. of Germany

[21] Appl. No.: 819,096

[22] Filed: Jul. 26, 1977

[30] Foreign Application Priority Data

Sep. 18, 1976 [DE] Fed. Rep. of Germany ..... 2642099

[51] Int. Cl.[2] ..... H05B 5/16

[52] U.S. Cl. ..... 219/10.69; 198/773; 414/156

[58] Field of Search ..... 219/10.69, 10.67, 10.71, 219/10.73; 198/772, 773, 777, 750; 214/23, 26, 27, 31

[56] References Cited

U.S. PATENT DOCUMENTS 4,079,222 3/1978 Scheffler ..... 219/10.69

FOREIGN PATENT DOCUMENTS 2634521 2/1978 Fed. Rep. of Germany ..... 219/10.69

964439 7/1964 United Kingdom ..... 219/10.69

*Primary Examiner*—Bruce A. Reynolds

*Attorney, Agent, or Firm*—Cushman, Darby & Cushman

[57] ABSTRACT

A furnace for the inductive heating of metallic workpieces with an induction coil body encompassing a furnace space through which workpieces on receivers are transported. The receivers are a pair of hollow tubes extending in parallel through the furnace space for receiving workpieces, the tubes being reciprocally moved backwards and forwards. A pair of rods having cam surfaces thereon extend through the space below the tubes so that rotation of the rods lifts the workpieces off the tubes during backwards movement.

4 Claims, 3 Drawing Figures

FURNACE FOR THE INDUCTIVE HEATING OF METALLIC WORKPIECES

This invention relates to a furnace for the inductive heating of metallic workpieces with an induction coil body encompassing the furnace space and with a receiver for the workpiece, mounted to be movable to-and-fro in the longitudinal direction and penetrating the induction coil body in its longitudinal direction for the transportation of the workpieces through the induction coil body and with repositories for the workpiece disposed in the induction coil body along the receiver of the workpiece for depositing said workpieces. The receiver of the workpieces is disposed to be movable in the direction of transportation above driving means disposed outside of the induction coil body, in such a way that the workpieces placed at the entrance to the furnace onto the receiver are transported step by step from one workpiece repository to the next following one and to the outlet of the furnace.

In known furnaces of this construction, the workpieces are transported on a lifter conveyor, with a workpiece on each lifter. The lifter moves along the entire length of the furnace space and may be motor driven via corresponding mechanical driving means at the two front sides of the continuous furnace. For this purpose the lifter first carries out a lifting movement transversely to the direction of transportation. In this lifting movement, the lifter reaches through a storage arrangement for workpieces and lifts off a workpiece stored there. After that, the lifter carries the workpiece through the furnace where it is then deposited onto a corresponding repository. After that, the lifter, below the repositories for the workpieces, returns oppositely to the previous movement. When the lifter has returned to its original starting position the just explained transportation process may take place again.

Known continuous furnaces suffer from being limited to a relatively short length, since the lifter may not be of any arbitrary length because of the flexure of the beam. Whenever certain lengths of the furnace arrangement are exceeded, then the transportation apparatus assumes large dimensions in order to bring about the required sag stability, which results in an undesirable widening of the diameter of the induction coils enclosing the space of passage of the furnace.

It has, therefore, been known to provide several continuous furnaces of the above-mentioned type disposed one behind the other for the sequential heating of individual workpieces. At the same time, it is unavoidable that a distance remains between the individual furnaces in which each workpiece as it leaves one furnace and is fed toward the entry of the other furnace, is not heated. The effectiveness of such installations is, therefore, not favorable.

The present invention deals with the task of improving continuous induction furnaces of the type described initially in more detail, so that, even with an increasing length of the furnace space, sag of the workpiece receiver mounted to be movable in the direction of transportation, will not occur and large dimensioning of the workpiece receiver to avoid sag can be avoided.

Furthermore, the invention permits transportation of the workpieces through the furnace space solely with the use of parts which penetrate the furnace space in the axial direction of the induction coil body without any necessity for guiding through the coil body. Further, the individual workpieces that pass through the furnace are disposed succeeding each other directly, so that they will touch each other and thus are electrically and conductively interconnected, without transmitting considerable forces from one workpiece to the other during the transportation of a column of workpieces, which forces tend to glue or weld the workpieces together.

According to the invention, a furnace is proposed with lifters between the receiver for the workpieces disposed translatorily in bearings, the lifters serving as repositories for the workpieces and disposed inside of the induction coil body, jointly from the direction of the side of the furnace entrance and/or of the furnace exit. Rotatably mounted cams function as lifters, which cams may be driven jointly via a rod penetrating the coil body in the direction of transportation. The cams may be attached to the driving rod and may be mounted rotatably with the driving rod around its axis.

The furnace arrangement of the present invention has the advantage that the individual workpieces may be transported through the furnace in a workpiece column abutting each other directly. Without that, as is common in the case of the new pusher type furnaces, transportation forces are transmitted to the workpiece column via a pusher type apparatus disposed at the entry of the furnace, which forces press the individual workpieces against each other and thereby possibly give rise to a gluing or welding together of the workpieces. A further advantage is that even individual workpieces may be transported through the furnace.

The attached drawing serves as an explanation of a preferred embodiment in which.

Figure 2A:
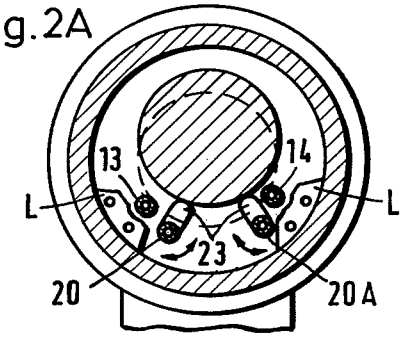
FIG. 2 shows a section along the lines II—II in FIG. 1.
Figure 2:
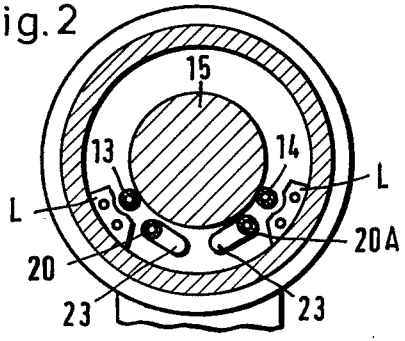

FIG. 2*a* is a view as in FIG. 2 at a dirrerent point during transportation of the workpieces through the furnace space.

Figure 1:
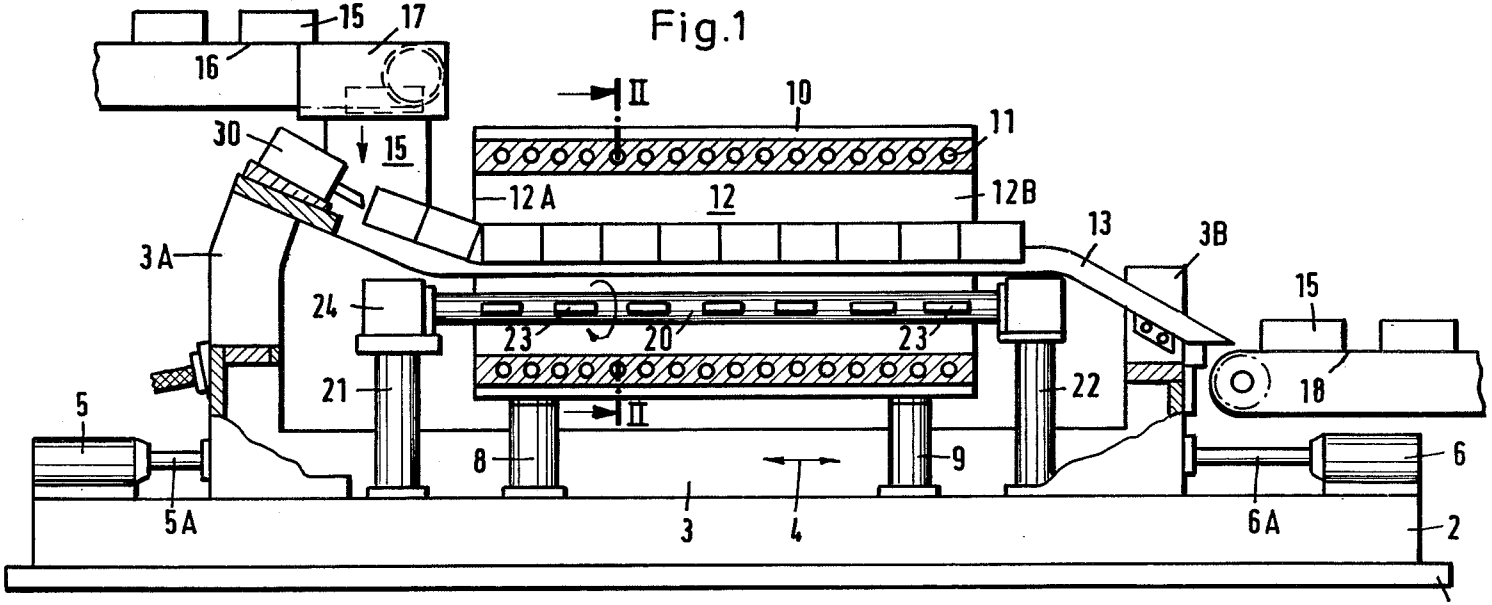
FIG. 1 shows in a schematic presentation and partly in section a side view of a furnace arrangement of the present invention.

In FIG. 1, the numeral 1 designates the foundation of a heating machine according to the invention on which a carriage-shaped construction element 3 is mounted to be reciprocally movable in a bearing part 2 in the direction of the double arrow 4. The movement of the construction part 3 is controllable via double admissible hydraulic piston motors 5 and 6. The cylinders of the piston motors for this purpose have been mounted to be locally fixed on the construction part 2 and are connected via adjusting bars 5A and 6A with construction part 3. On the bearing part 2 an induction coil body 10 has been mounted locally fixed on bearing bars 8 and 9, the winding 11 of which inductively heats the furnace space 12 enclosed by it.

Furnace space 12 is completely penetrated by a workpiece receiver in the direction of the axis of the induction coil body 10, which receiver consists of two metal tubes 13 and 14 (see FIG. 2) of heat resistant material. The metal tubes 13 and 14 are attached to two column-like elevations 3A and 3B of the carriage-shaped construction element 3, and run, penetrating the furnace space 12, in parallel one beside the other. Tubes 13 and 14 are mounted in the inside of the furnace space 12 in friction bearings (see FIG. 2), which are disposed successively in the axial direction of the coils, shiftable with the construction part 3 in the direction of the double arrow 4. In front of the entrance 12A of the induction coil body 10 and behind its outlet 12B, tubes 13 and 14 are disposed slanting toward the horizontal plane, so that metallic workpieces 15 placed onto the entry 12A to the furnace, slide down the slanting part of the tubes 13 and 14, are fed to the furnace entrance 12A and are taken away at the outlet 12B, after their transportation through the furnace space 12, via the part of the workpiece receiver disposed at the furnace outlet, sliding out of the furnace space 12.

A transportation belt 16 precedes the furnace entrance 12A, which in connection with a conventional feeder 17, serves for the feeding of the workpieces 15 to the furnace entrance 12A. A delivery belt 18 is series connected to the furnace outlet 12B, which feeds the workpieces 15 which have slid out of the inside of the furnace space 12, to an additional processing machine, e.g., a forging machine.

Two bars 20 and 20A consisting of heat resistant material penetrate the furnace space 12 in parallel to the bars 13 and 14 of the workpiece receiver and are mounted on the construction part 2 by way of pillar-shaped bearing columns 21 and 22. Bars 20 and 20A are mounted rotatable in the bearing columns 21 and 22 around their longitudinal axis by 90° and are provided along their longitudinal extent with several projections or cams 23 and arranged at a small distance from one another, which are rotatable by 90° by way of a driving motor 24 with the bars 20 and 20A serving for the rotation of the bars. The cams 23 of the bars 20 and 20A are mounted below the workpieces 15 disposed on tubes 13 and 14. Rotation of the bars 20 and 20A by driving motor 24 (see FIG. 2*a*) lifts workpieces 15 from tubes 13 and 14 and holds them above tubes 13 and 14 on cams 23.

A hydraulic piston motor 30 is mounted on the construction part 3A, for shifting of a workpiece 15 placed on the side of the furnace entrance 12A onto the workpiece receiver in the direction of the furnace entrance 12A. The motor 30 is an auxiliary arrangement. The above described arrangement operates as follows. The individual workpieces 15 are placed with the help of the conveyor belt 16 via the feeder 17 at the furnace entrance 12A onto tubes 13 and 14 and are transported to the furnace entrance 12A with the help of the piston motor 30. In the corresponding position, each workpiece 15 which has reached the furnace entrance, is lifted in turn from tubes 13 and 14 by rotating cams 23 into a position shown in FIG. 2*a*. By operation of the motors 5 and 6, the construction part 2 is now transported into its left terminal position. Then the bars 20 and 20A are rotated back into their original position by operation of the motor 24, as a result of which the workpiece 15 is again deposited onto tubes 13 and 14 and is transported by operation of the motors 5 and 6 together with the workpiece receiver into the right terminal position of the construction part 3. The process described is repeated until the workpiece 15 has reached the conveyor belt 18 via the outlet 12B of the coil body 10 and the slidelike part of the workpiece receiver, and is fed from this belt for further processing.

For the rotation of the driving bars 20 and 20A is used a common driving motor 24. However, separate driving motors can also be used. The control of the driving motors takes place via a conventional control arrangement inphase in relation to the control of the driving motors 5 and 6 for the construction part 3. It is within the scope of the invention to mount the cams 23 individually swivelable in the inside of the furnace space 12 and to operate a common driving rod from the direction of the furnace entrance or of the furnace exit.

It is, furthermore, within the scope of the invention to equip tubes 13 and 14 and the driving bars 20, 20A with means for the water cooling for which purpose the rod-shaped construction parts are developed as pipes and may be charged in their inside with cooling water. It is furthermore within the scope of the invention to replace the driving motors 5 and 6 by a single driving motor which drives the carriage-shaped construction part 3, which possibly may be mounted on rollers, by way of a gearing.

What is claimed is:

1. A furnace for the inductive heating of metallic workpieces comprising;
   - an induction coil body encompassing the furnace space;
   - a workpiece receiver for receiving workpieces and transporting said workpieces through such furnace space in a longitudinal direction, said receiver including a pair of hollow tubes extending through such space in parallel;
   - driving means outside said coil body for causing reciprocating forward and backward movement of said receiver in said longitudinal direction; and
   - means within said furnace for lifting said workpieces from said receiver during backward movement of said receiver so that said workpieces remain longitudinally stationary during said backward movement of said receiver, said workpieces advancing through said furnace space during said forward movement of said receiver, said lifting means including a pair of rotatable bars extending through said space below said tubes, said bars having cam surfaces thereon and means for rotating said bars so that said cam surfaces engage said workpieces to lift said workpieces from said tubes.

2. A furnace as in claim 1, further including a base and wherein said driving means includes a construction part movable on said base, first and second motors for moving said part along said base, and means for mounting said tubes onto said construction part.

3. A furnace as in claim 2, including means for mounting said rotatable bars on said base, and means for mounting said coil body on said base.

4. A furnace as in claim 1, including means for supplying workpieces to the input of said furnace space.

* * * * *